United States Patent [19]

Grinsteiner

[11] Patent Number: 4,763,616

[45] Date of Patent: Aug. 16, 1988

[54] VALVE LEVER WITH BALL BEARING PIVOT

[75] Inventor: James J. Grinsteiner, Roselle, Ill.

[73] Assignee: Navistar International Transportation Corp., Chicago, Ill.

[21] Appl. No.: 65,814

[22] Filed: Jun. 23, 1987

[51] Int. Cl.[4] ..... F01L 1/18

[52] U.S. Cl. ..... 123/90.42; 123/90.41

[58] Field of Search ..... 123/90.39, 90.41, 90.42

[56] References Cited

U.S. PATENT DOCUMENTS

| | | | |
|---|---|---|---|
| Re. 16,205 | 11/1925 | Asbury | 123/90.41 |
| 1,521,623 | 1/1925 | Hendrickson | 123/90.39 |
| 1,557,548 | 10/1925 | Asbury | 123/90.41 |
| 1,588,041 | 6/1926 | Moore | 123/90.42 |
| 1,612,792 | 1/1927 | Asbury | 123/90.41 |
| 1,699,657 | 1/1929 | Fagan | 123/90.39 |
| 1,902,696 | 3/1933 | Eimer | 123/90.39 |
| 2,970,585 | 2/1961 | Lombardi | 123/90.39 |
| 3,016,887 | 1/1962 | Streit et al. | 123/90.41 |
| 3,251,350 | 5/1966 | Thompson | 123/90.41 |
| 3,274,983 | 9/1966 | Herring | 123/90.42 |
| 3,563,215 | 2/1971 | Ross | 123/90.42 |
| 4,132,196 | 1/1979 | Wherry | 123/90.39 |
| 4,393,820 | 7/1983 | Maki et al. | 123/90.41 |
| 4,440,121 | 4/1984 | Clancy et al. | 123/90.41 |

*Primary Examiner*—Willis R. Wolfe

*Attorney, Agent, or Firm*—F. David Aubuchon; Dennis K. Sullivan

[57] ABSTRACT

A relatively thin, post-mounted valve lever having a ball bearing pivot for operating an intake or exhaust valve of an internal combustion engine and having a lateral bearing surface which slidably engages aligned spaced lateral surfaces on a wide supporting post which maintain the rocking plane within the valve lever.

9 Claims, 1 Drawing Sheet

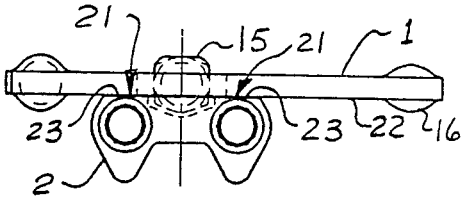
FIG. 1
FIG. 2
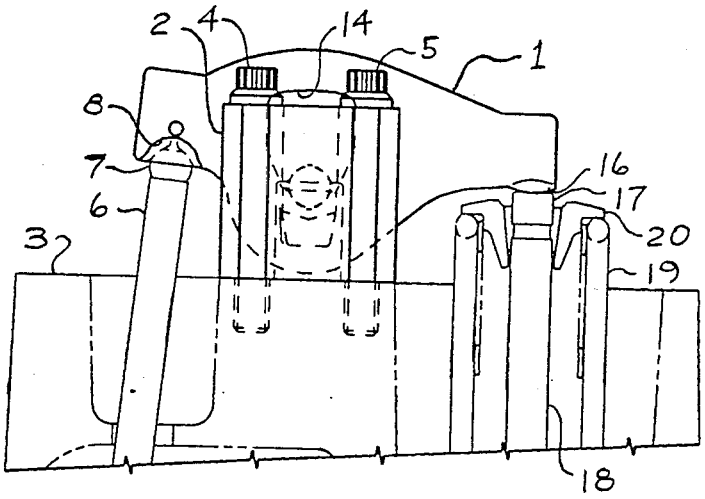
FIG. 3
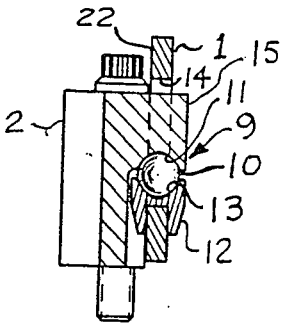

VALVE LEVER WITH BALL BEARING PIVOT

This invention relates to a rocker arm on an internal combustion engine and more particularly to the valve rocker arm with a ball bearing pivot to operate an intake or exhaust valve of an internal combustion engine.

In the conventional low-speed engine the design of the rocker arm or valve rocker arm is not critical. High speed engines and supercharged engines present a problem of space limitations and inertia forces on the valve train not normally experienced with the conventional low-speed engine. Accordingly, the rocker arm of the modern high-speed engine should be designed for greater efficiency, smooth operation and to reduce inertia forces in the valve train. The Asbury patent, U.S. Pat. No. 1,612,792, shows a rocker arm assembly for operating a valve on an internal combustion engine. This rocker arm does employ a spherical element or ball at the fulcrum point for pivoting of the rocker arm. The ratio of operation of the rocker arm does not appear to remain constant since the spherical element can roll on the surface between the pins on the rocker arm. The general construction of the rocker arm is not similar to that of the applicant's invention.

The Moore patent, U.S. Pat. No. 1,588,041, also shows a rocker arm assembly in which the ratio of the rocker arm is intentionally designed to vary the rate of opening initially relative to subsequent ratio of the rocker arm. This is to provide a greater mechanical ratio initially and a faster opening later on. The fulcrum point and the structure between the rocker arm and the push rod as well as the rocker arm and the valve stem are not similar to the applicant's invention.

Wherry patent, U.S. Pat. No. 4,132,196 shows a relatively thin section rocker arm. However, Wherry is not post mounted, but rather is mounted on a rocker arm shaft and the portion of Wherry providing mounting on that shaft is not at all thin.

The applicant has provided a post-mounted low inertia rocker arm in which the rocker arm has a slender configuration but substantial depth to assure stiffness for transmission of force from the push rod to the valve stem. The design of the applicant's invention provides low inertia forces in the valve train and an efficient operation of the valve on a ball pivoting fulcrum. Accordingly, the applicant's invention is believed to be distinguishable over these rocker arms.

Accordingly, it is an object of this invention to provide a post-mounted low inertia and lightweight rocker arm for an internal combustion engine.

It is another object of this invention to provide a low inertia and lightweight rocker arm with stiffness for transmitting the actuating force from the push rod to the valve stem.

It is a further object of this invention to provide a low inertia rocker arm with a ball bearing pivot at the fulcrum point for efficient operation of the valve rocker arm.

It is a further object of this invention to provide a lightweight, low inertia rocker arm for operating in an engine of limited space availability and having minimum inertia stress in the valve train.

The objects of this invention are accomplished with a rocker arm pivotally mounted on a ball bearing fulcrum. A push rod end forms a ball received in a socket of the rocker arm for operating the rocker arm while a curved surface on the opposite end of the rocker arm operates against a valve stem. The rocker arm is of thin construction with sufficient depth to provide stiffness for transmitting the operating force from the push rod to the valve stem. The arm bears laterally on a wide mounting post which pivotally supports the rocker arm to maintain the pivoting plane of the rocker arm so that the forces operate within the dimensions of the rocker arm. The ball and socket fulcrum provide an efficient pivot point and the lateral surface bearing maintains the alignment of the pivoting plane of the rocker arm. The thin construction of the rocker arm reduces inertia forces and stresses in the valve train.

Referring to the drawings,

FIG. 1 illustrates a plan view of the valve operating mechanism.

FIG. 2 illustrates a side-elevation view of the valve operating mechanism.

FIG. 3 is a cross-section view of the valve operating mechanism through the fulcrum point of the rocker arm.

Referring to the drawings, the rocker arm 1 is pivotally supported on a wide post 2. The post 2 is mounted on the engine head 3 and fastened by the bolts 4 and 5. A push rod 6 is operated by a suitable cam shaft not shown. The push rod 6 includes a spherical end 7 operating against a spherical seat 8 in the end of the rocker arm 1. A fulcrum 9 is formed by a ball 10 disposed in fixed position in the spherical socket 11 of the post 2. An insert 12 is permanently seated on the rocker arm 1 and forms a spherical socket 13 which receives the lower portion of the ball 10 and maintains it in fixed position between the ends of the rocker arm, thus maintaining a relatively fixed rocker arm ratio.

The rocker arm 1 forms an opening 14 which receives a bearing support portion 15 of the wide post 2 which projects outwardly from aligned lateral surfaces 23 disposed on both sides of support 15 closely adjacent lateral surface 22 of rocker arm 1.

The rocker arm 1 forms a convex curved surface 16 which operates the upper end 17 of the valve stem 18. The valve is normally closed by the spring 19 which engages a valve seat 20 on the stem 18 of the valve. Opening of the valve is accomplished by pressing the valve stem 18 downwardly against the force of the spring 19. The push rod 6, normally operated by a cam shaft, is biased upwardly by a cam lobe pivoting the rocker arm 1 in a clockwise direction as viewed in FIG. 2.

The device operates in the following described manner. The rocker arm 1 is pivotally supported on its fulcrum 9 formed by the ball 10 seated in the spherical socket of housing 11 of the wide post 2. The ball also seats in the spherical recess of the insert 12 which is carried on the rocker arm 1. Normally, the rocker arm 1 is pressed upwardly by a cam shaft operating on the push rod 6. A spring 19 engaging the spring seat 20 presses the valve stem 18 upwardly against the convex surface 16. The spring closes the valve when the cam on the cam shaft allows the valve to close, the valve being closed by the spring. The valve is opened by a cam lobe on the cam shaft operating through the push rod to pivot the rocker arm 1 forcing the valve stem 18 downwardly. Rotating of the cam allows the rocker arm 1 to pivot counterclockwise and closes the valve.

The rocker arm 1 is essentially a flat member with a seat engaging a spherical end 7 of the push rod 6 which operates the rocker arm. The opposite end of the rocker arm is formed with a convex surface 16 which engages the end 17 of the valve stem 18. The rocker arm is relatively thin normal to the pivoting plane and lightweight and reduces inertial loading in the valve train mechanism to a minimum. The rocker arm, although relatively thin, is aligned so the forces operate in a pivotal plane within the confines of the rocker arm and the stiffness of the rocker arm is achieved by the depth of the arm per se in the pivoting plane and allows transmission of the force from the push rod 6 to the valve stem 18 without any deformity of the rocker arm. This also provides a rocker arm requiring a limited space. The rocker arm is positioned closely adjacent, on the order of 0.25 mm, to the side of wide post 2 to form bearing interfaces 21 formed by the lateral surface 22 of the rocker arm and the aligned lateral surfaces 23 of the side of the post 2. The surfaces 23 cover a fairly substantial area on both sides of the post 2 and are located at least one bearing diameter away from the center of ball bearing 10 to maintain the pivotal alignment of the rocker arm in operation. Accordingly, the pivotal movement of the rocker arm is controlled by the ball bearing on which the rocker arm pivots as well as the lateral interfaces 21 between the rocker arm and the wide post 2.

The embodiments of the invention in which an exclusive property or privilege is claimed are defined as:

1. A valve operating mechanism for an internal combustion engine comprising, a rocker arm adapted for operation by a push rod and operating a valve, fulcrum means on said rocker arm including a ball bearing disposed in fixed position thereon, support post means carrying the ball bearing in fixed position and having a lateral surface closely adjacent to the side of said rocker arm to form a bearing interface therewith and causing said rocker arm to pivot in a plane lying within said rocker arm, said rocker arm defining a narrow width and a substantial depth to provide stiffness for transmission of an operating force from said push rod to said valve.

2. A valve operating mechanism for an internal combustion engine as set forth in claim 1, wherein said fulcrum means includes a ball and socket pivotal bearing.

3. A valve operating mechanism for an internal combustion engine comprising, a rocker arm, a push rod operating said rocker arm, a valve operated by said rocker arm, a wide post pivotally supporting said rocker arm, means defining a fulcrum on said post pivotally supporting said rocker arm including a ball bearing, spaced lateral bearing surfaces on the side of said wide post located at least one bearing diameter from the center of pivotting and slidably engaging said rocker arm to maintain the pivotal plane of said rocker arm, said rocker arm defining a thin structure normal to the pivotal plane of said rocker arm, said rocker arm defining a substantial depth to provide stiffness and rigid force transmitting characteristics from said push rod to said valve.

4. A valve operating mechanism for an internal combustion engine as set forth in claim 3, wherein said rocker arm defines a central opening, said ball bearing received in said opening for pivotally supporting said rocker arm on said wide post.

5. A valve operating mechanism for an internal combustion engine as set forth in claim 4, wherein the end of said rocker arm operating said valve defines a convex curved surface engaging a stem of said valve.

6. A valve operating mechanism for an internal combustion engine comprising, a rocker arm, a wide post pivotally supporting said rocker arm, said wide post defining a pivotal bearing forming a ball and socket with said rocker arm, and a lateral bearing formed by mating surfaces on said post and rocker arm forming an interface to maintain the pivotal plane parallel with the interface, said rocker arm defining a narrow flat structure of substantial depth to provide stiffness for transmission of the valve operating force from said push rod to said valve.

7. A valve operating mechanism for an internal combustion engine as set forth in claim 6, wherein said ball and socket includes a socket insert positioned on said rocker arm and a ball pivotally connected between said insert and a socket in said wide post.

8. A valve opeating mechanism for an internal combustion engine as set forth in claim 7, wherein said interfaces forming a bearing between said rocker arm and said wide post extends fore and aft of the pivotal ball and socket bearing at least one spherical bearing diameter therefrom.

9. A valve operating mechanism for an internal combustion engine as set forth in claim 8, including means defining a central opening in said rocker arm, said ball and socket bearing received in said opening for pivotally supporting said rocker arm on said wide post.

* * * * *